US005634222A

United States Patent [19]

Zwickey

[11] Patent Number: 5,634,222

[45] Date of Patent: Jun. 3, 1997

[54] CARDIOPULMONARY RESUSCITATION BACK SUPPORT

[76] Inventor: Wayne C. Zwickey, 209 12th Ave. Northeast, Minneapolis, Minn. 55413

[21] Appl. No.: 411,888

[22] Filed: Mar. 28, 1995

Related U.S. Application Data

[63] Continuation-in-part of Ser. No. 138,245, Oct. 15, 1993, Pat. No. 5,400,448.

[51] Int. Cl.[6] ..... A61G 1/00

[52] U.S. Cl. ..... 5/628; 5/694; 5/612; 5/626; 128/845

[58] Field of Search ..... 5/612, 625, 626, 5/628, 454, 462, 652, 621, 630, 633, 634, 694, 708; 128/845, 846, DIG. 20

[56] References Cited

U.S. PATENT DOCUMENTS

| | | | |
|---|---|---|---|
| 1,295,770 | 2/1919 | Lamont . | |
| 3,146,469 | 9/1964 | Slade | 5/91 |
| 3,419,920 | 1/1969 | Maddux, Jr. et al. | 5/91 |
| 3,461,858 | 8/1969 | Michelson | 5/633 X |
| 3,803,646 | 4/1974 | Newerowski | 5/345 R |
| 4,168,554 | 9/1979 | Hindes | 5/446 |
| 4,194,732 | 3/1980 | Liebman | 5/628 |
| 4,628,557 | 12/1986 | Murphy | 5/446 |
| 4,706,313 | 11/1987 | Murphy | 5/464 |
| 4,757,811 | 7/1988 | Clark | 128/134 |
| 4,791,687 | 12/1988 | Iwase | 5/454 |
| 4,819,286 | 4/1989 | Beauchamp | 5/431 |
| 4,977,630 | 12/1990 | Oswalt et al. | 5/81 R |
| 4,979,520 | 12/1990 | Boone, Jr. et al. | 128/870 |
| 5,016,620 | 5/1991 | Matthews | 128/78 |
| 5,046,205 | 9/1991 | Garcia | 5/454 |
| 5,101,527 | 4/1992 | Wadsworth, III et al. | 5/464 |
| 5,107,558 | 4/1992 | Luck | 4/464 |
| 5,121,756 | 6/1992 | Koledin | 128/870 |
| 5,154,185 | 10/1992 | Latimer et al. | 128/870 |
| 5,287,577 | 2/1994 | Bremer et al. | 5/454 |
| 5,382,226 | 1/1995 | Graham | 128/845 X |

FOREIGN PATENT DOCUMENTS

| | | | |
|---|---|---|---|
| 28375 | of 1910 | United Kingdom | 5/454 |
| WO93/21871 | 11/1993 | WIPO . | |

*Primary Examiner*—Michael F. Trettel
*Attorney, Agent, or Firm*—Nawrocki, Rooney & Sivertson, P.A.

[57] ABSTRACT

An airway opening device including back elevating inflatable bladder and inflation device in fluid communication with the bladder. The inflation device provides fluid under pressure to inflate the bladder. The airway opening device can be incorporated into a gurney mattress in accordance with the present invention.

4 Claims, 6 Drawing Sheets

CARDIOPULMONARY RESUSCITATION BACK SUPPORT

CROSS REFERENCE TO CO-PENDING APPLICATION

This application is a continuation-in-part of U.S. application Ser. No. 08/138,245, filed Oct. 15, 1993, now U.S. Pat. No. 9,400,448.

FIELD OF THE INVENTION

The present invention pertains generally to cardiopulmonary resuscitation (CPR) devices and, in particular, to a device for opening a person's airway. The device can be incorporated into an ambulance gurney mattress.

BACKGROUND OF THE INVENTION

Ambulance gurneys have long been used for transporting injured or incapacitated people. Typical ambulance gurneys generally include a mattress resting atop and/or fastened to a supporting surface. The supporting surface is generally mounted atop a wheeled, adjustable frame. The wheels allow the gurney to be pushed or pulled along the ground. The height of the mattress relative to the ground can be varied by adjusting the frame.

Prior to applicant's invention, the length and width of most gurney mattresses were configured to accommodate an adult patient. Harnesses attached to the gurney extended width-wise across the mattress to retain the patient on the mattress. Like the mattress, the harness was sized to accommodate adult patients.

CPR must often be performed on gurney mattresses. Prior to applicant's invention, attendants who performed CPR generally opened a patient's airway by holding a supine patient's head and tilting it back away from the patient's chest. This procedure was considered necessary to open the patient's airway for normal or artificial respiration, however, the procedure placed significant stress on the patient's upper spine. If a patient was suspected to have a spinal cord injury, the attendant faced a dilemma between potentially aggravating a spinal cord injury by tilting a patient's head or not fully opening the patient's airway.

SUMMARY OF THE INVENTION

The present invention pertains to an improved gurney mattress, sized to accommodate both adult and non-adult patients. Applicant's invention provides a mattress to secure both adult and non-adult patients.

The gurney mattress in accordance with the present invention can include an airway opening device. The device can elevate the chest and upper back of a supine patient relative to the patient's head to open the patient's airway for CPR. The airway opening device can include a back elevating inflatable bladder. An inflation device in fluid communication with the bladder can be provided to supply fluid under pressure to inflate the bladder. Usually the inflation fluid is air.

The gurney mattress of the present invention may include a cushion having a bottom surface configured to be placed on a gurney and a top surface configured to support an adult. There may be a compartment within the cushion having a bottom and sides configured to contain a non-adult patient.

The cushion can include a foam pad surrounded by a cover. The cover can have an opening into the compartment within the cushion. The cover can include a zipper for alternately opening and closing the opening.

The mattress can include a CPR board disposed proximate the top surface of the cushion between the cover and the foam padding. If the gurney mattress includes a CPR board, a heart symbol may be disposed on the top surface to indicate the existence and location of the CPR board.

The compartment may include a harness configured to surround and retain a non-adult patient within the compartment. The compartment may also be configured to receive a backboard for a non-adult patient.

In one of the embodiments of the gurney mattress, an elongated cover defines a first compartment having a top, bottom, and oppositely disposed sides. The compartment is configured to contain a non-adult patient. The top can be hingably attached with respect to the remainder of the cover allowing the compartment to be alternately opened and closed. Padded bumpers may be disposed within the compartment adjacent the sides.

A cushion can be attached to the top so that when the compartment is closed, the cushion is disposed within the compartment and between the padded bumpers. When the compartment is opened, the cushion is removed from the compartment.

The elongated covering may define a second compartment having a top, bottom and oppositely disposed sides. The second compartment is also configured to contain a non-adult patient. The second compartment may be configured to contain a smaller non-adult patient than the first compartment.

Like the first compartment, the second compartment may include padded bumpers disposed adjacent the sides, and a cushion attached to the top of the second compartment. The top of the second compartment can be hingably attached relative to the remainder of the cover allowing the second compartment to be alternately opened and closed so that when the second compartment is closed, the cushion is disposed within the second compartment generally between the padded bumpers. When the compartment is opened, the cushion is removed from the compartment. Both the first and second compartments may contain a harness configured to retain a non-adult patient within each respective compartment.

The padded bumpers may be surrounded by a fluid-resistant covering, and attached by hook and loop fastener to the cover. A head immobilization device, also at least partially covered by a fluid-resistant covering, may be operably connected to the cover by hook and loop fastener. A skinned foam pad may be disposed on the bottom of the compartment.

In another embodiment of the gurney mattress configured for an adult patient, an elongated foam pad may be surrounded by a cover. A three point harness may be operably connected to the foam pad and configured to retain a non-adult patient on the mattress.

DETAILED DESCRIPTION OF THE INVENTION

Figure 1:
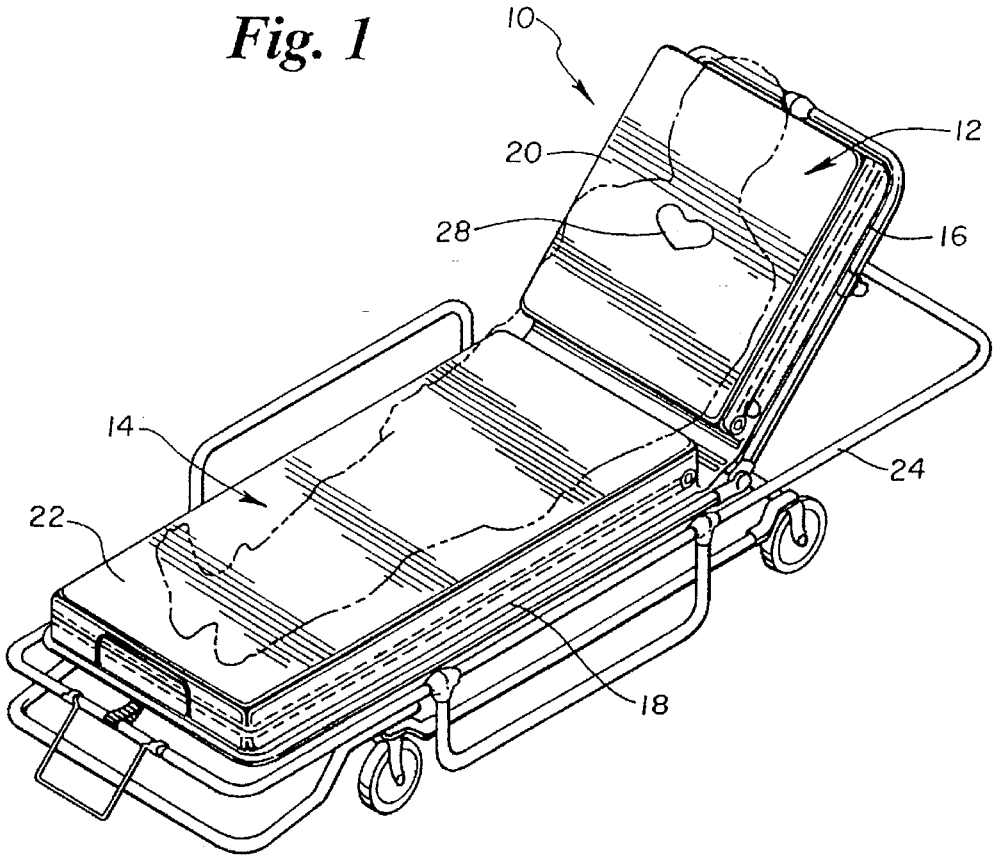
FIG. 1 is a perspective view of a gurney mattress in accordance with the present invention.

Referring now to the drawings wherein like reference numerals indicate like elements throughout the several views, FIG. 1 shows a gurney mattress 10 in accordance with the present invention. Gurney mattress 10 may include one or more cushions, for example cushions 12 and 14. Cushions 12 and 14 have bottom surfaces 16 and 18 and top surfaces 20 and 22, respectively. The bottom surface or surfaces 16 and 18 are configured to be placed on a gurney, such as gurney 24. The top surface or surfaces 20 and 22 are configured to support an adult patient as shown by broken line in FIG. 1.

Figure 2:
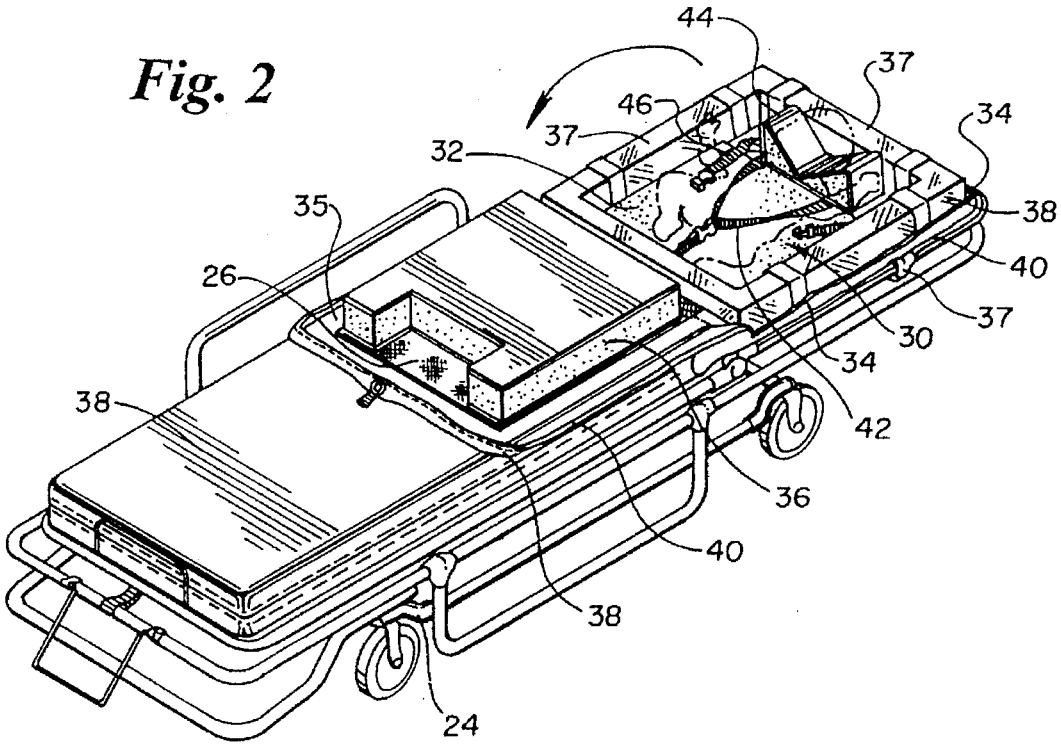
FIG. 2 is a perspective view of a gurney mattress in accordance with the present invention having an open compartment for a non-adult patient.

The gurney mattress may include a cardiopulmonary resuscitation (CPR) board 26 (as shown in FIG. 2). If the mattress includes a CPR board, a heart symbol 28 may be placed on the top surface 20 of cushion 12 to indicate the presence and location of CPR board 26.

As shown in FIG. 2, an elongated cover 38 may define a compartment 30 formed in cushion 12. Compartment 30 includes a bottom 32 and sides 34 configured to contain a non-adult patient. As used herein, non-adult refers generally to the patient's size rather than chronological age. The size of the non-adult patient would be significantly less than the size of an adult patient. An adult patient laying on the mattress 10 would extend over substantially the entire length of gurney mattress 10, whereas a non-adult patient would extend over substantially less than the entire length. A non-adult patient would likely, but not necessarily, be a preadolescent patient.

Cover 38 includes an opening into compartment 30 within cushion 12. As shown in FIG. 2, compartment 30 may include a top 35 hingably attached to the remainder of cover 38. Top 35 is hingably attached to alternately open and close the opening. Cover 38 may also include a zipper around the opening.

Padded bumpers 37 may be disposed proximate compartment 30 adjacent sides 34. A filler pad 36 may be attached to top 35 so that when compartment 30 is closed, pad 36 is received within compartment 30 between padded bumpers 37. When compartment 30 is opened, pad 36 is removed from compartment 30.

Compartment 30 may also include a harness 42 for retaining the non-adult patient in compartment 30. Harness 42 is preferably a three point harness having one strap configured to extend over each shoulder and a third between the legs of the non-adult patient.

A head immobilization device 44 may be fastened within compartment 30. In a preferred embodiment, the neck brace is similar to a device disclosed in U.S. Pat. No. 5,146,641 to Zwickey. A strap 46 operably connected to cover 38 may be provided to retain the patient's head in device 44.

Figure 3:
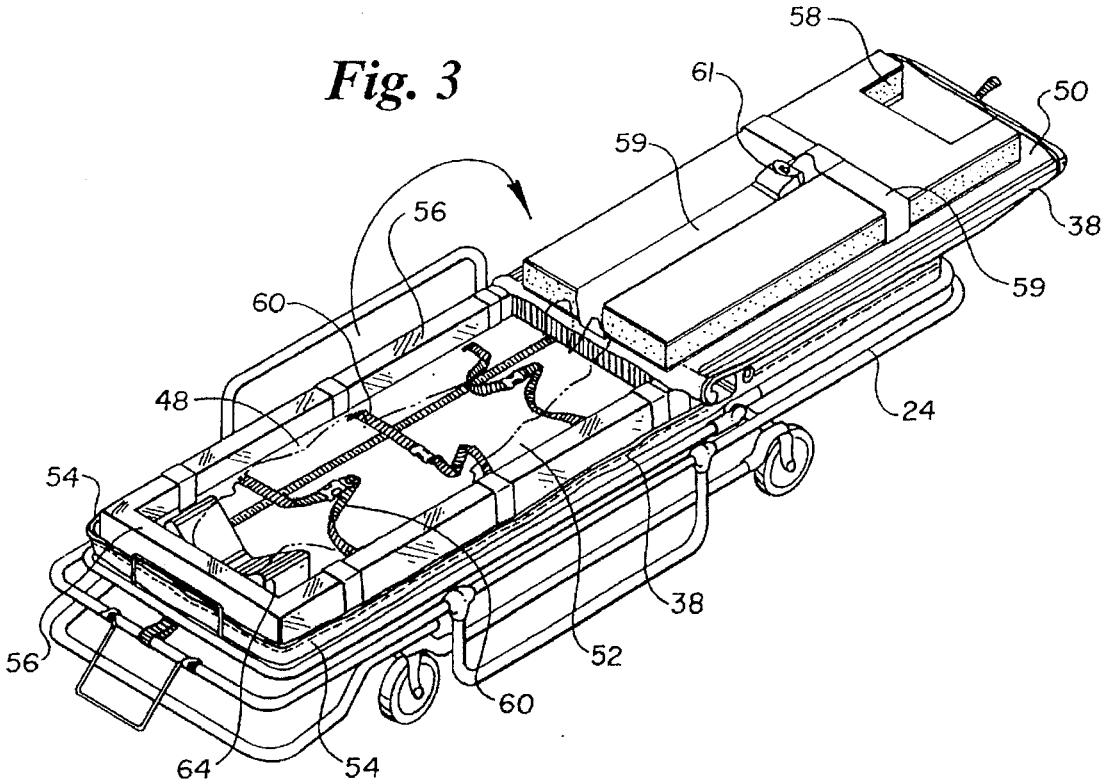
FIG. 3 is a perspective view of the gurney mattress in accordance with the present invention having a compartment opened for a larger non-adult patient.

As shown in FIG. 3, the elongated covering 38 may define a second compartment 48. Compartment 48 may include a top 50, bottom 52 and sides 54. Like compartment 30, second compartment 48 is configured to contain a non-adult patient. In one embodiment, second compartment 48 may be configured to contain a non-adult patient larger than the non-adult patient compartment 38 is configured to contain.

Padded bumper 56 may be placed within second compartment 48. A cushion 58 may be attached to top 50 of second compartment 48 by straps 59. A convenient tool pouch 61 may be attached to strap 59. Top 50 of compartment 48 may be hingably attached relative to the remainder of cover 38 allowing second compartment 48 to be alternatively opened and closed. When second compartment 48 is closed, cushion 58 is disposed within compartment 48 generally within the confines of padded bumper 56. When compartment 48 is opened, as shown in FIG. 3, cushion 58 is removed from compartment 48.

Figure 4:
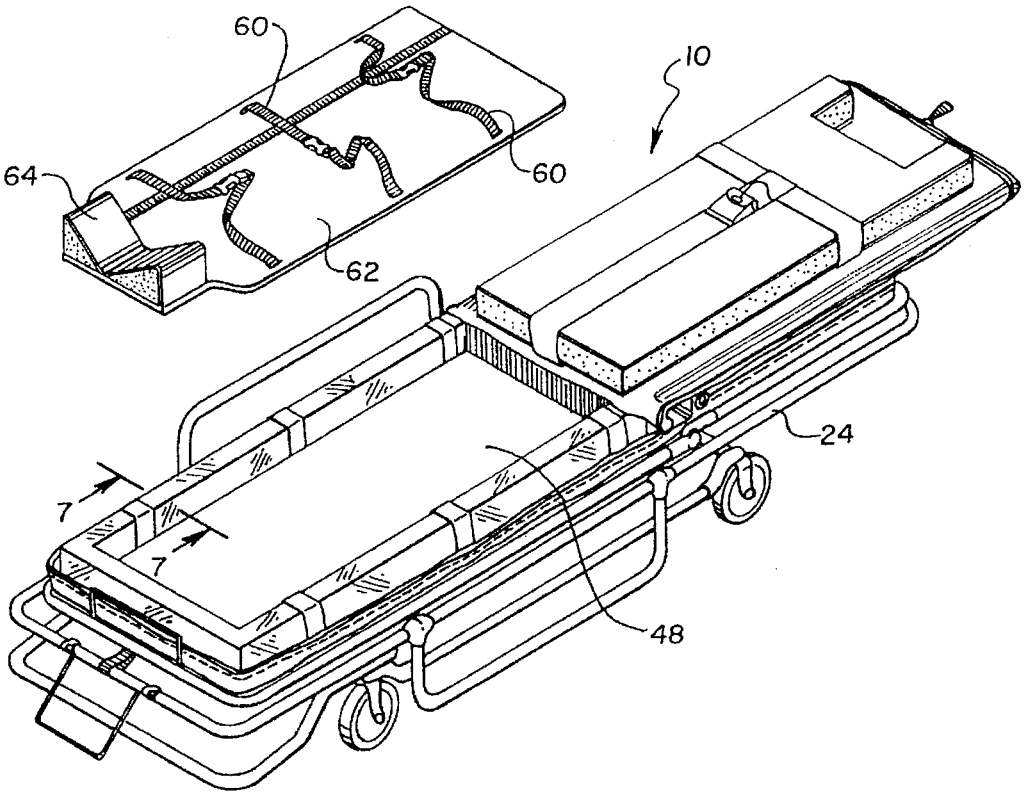
FIG. 4 is a perspective view of a gurney mattress in accordance with the present invention showing an optional backboard.

A harness 60 may be included in compartment 48. In one embodiment, as shown in FIG. 4, harness 60 is fastened to a backboard 62 which may be placed in compartment 48. Backboard 62 may also include an operably connected head immobilization device 64 similar to head immobilization device 44.

Figure 5:
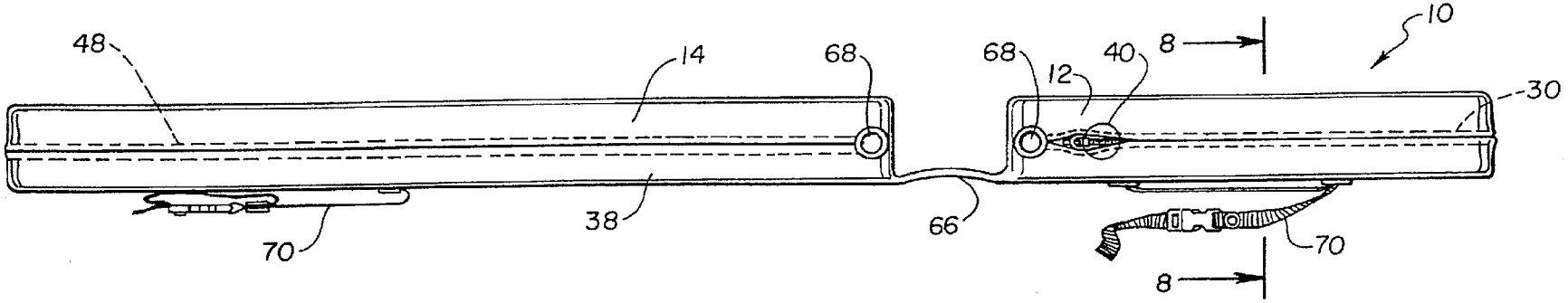
FIG. 5 is a side view of the gurney mattress in accordance with the present invention.
Figure 6:
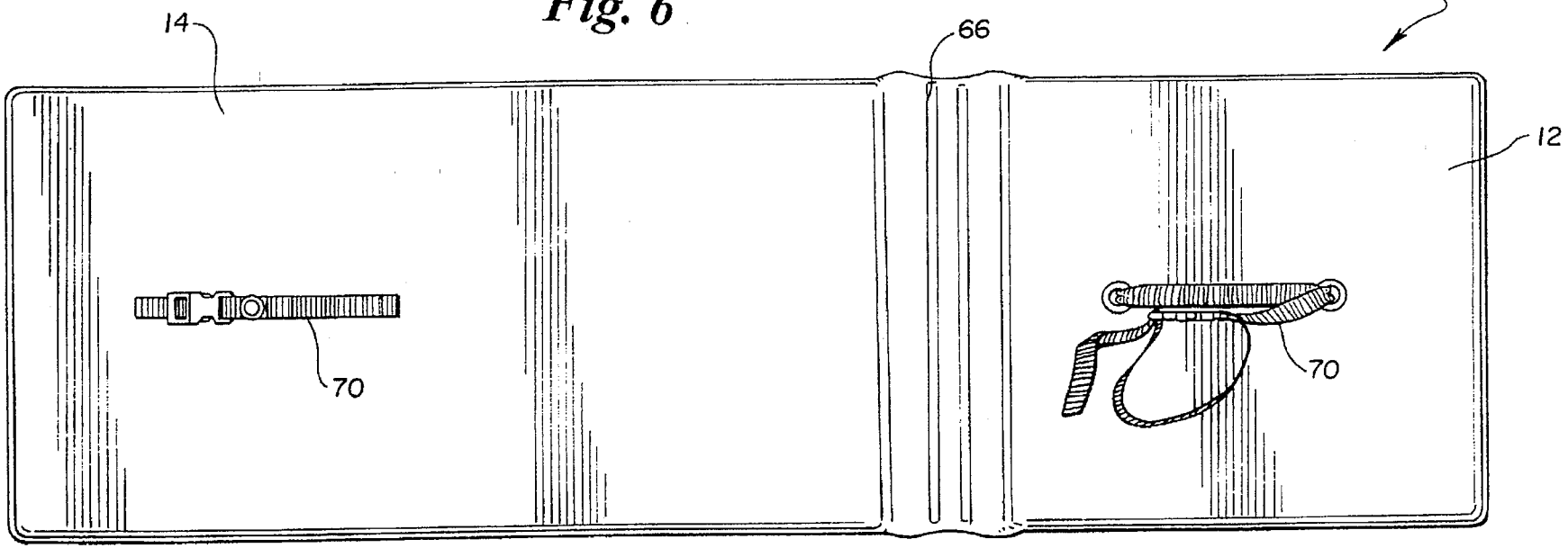
FIG. 6 is a bottom view of the gurney mattress in accordance with the present invention.

FIGS. 5 and 6 show top and bottom views of gurney mattress 10 respectively. As shown in FIG. 5, gurney mattress 10 includes two cushions 12 and 14 each defined by elongated cover 38. Marine grade vinyl may be used to make cover 38. Cushions 12 and 14 may be separated by a space, bridged by a web 66. Compartments 30 and 48 can be held closed by zippers 40. A vent hole 68 may extend into each compartment 30 and 48. Straps 70 can be provided to attach mattress 10 to gurney 24.

The materials used to construct mattress 10 have been selected, in part, in an effort to meet certain regulations of the Occupational Safety and Health Administration (OSHA).

Figure 7:
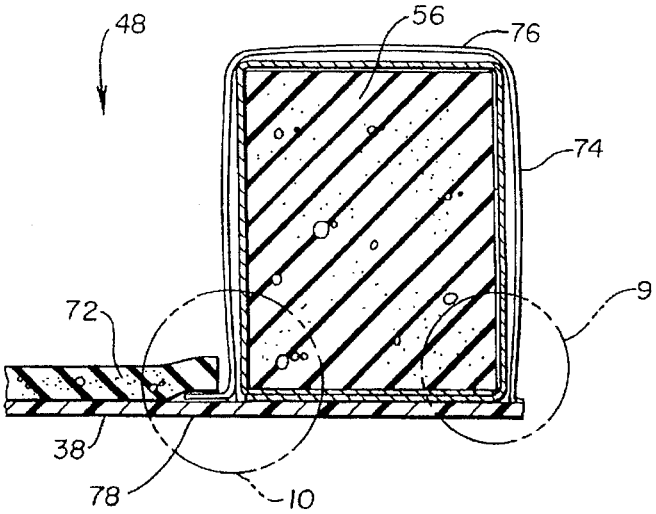
FIG. 7 is a partial cross-section of the gurney mattress in accordance with the present invention taken generally along line 7—7 of FIG. 4.
Figure 8:
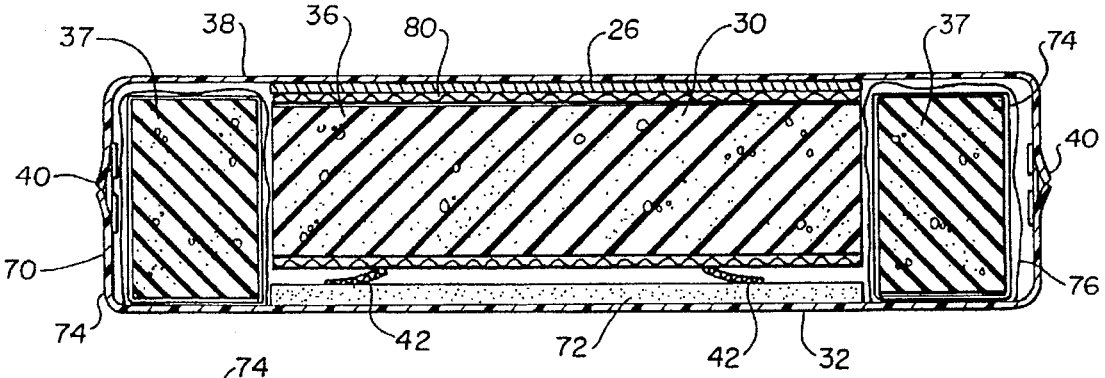
FIG. 8 is a cross-section of the gurney mattress in accordance with the present invention taken generally along line 8—8 of FIG. 5.
Figure 9:
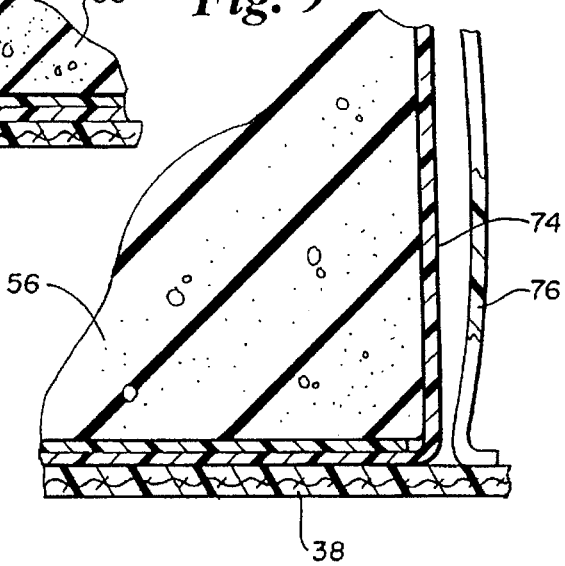
FIG. 9 is a partial cross-section of the gurney mattress in accordance with the present invention showing structure within the circle 9 in FIG. 7.

FIGS. 7–9 show various cross sections of mattress 10. FIG. 7 is a cross section taken from FIG. 4 extended partially through compartment 48. A skinned foam pad 72 may be fastened to bottom 52 of second compartment 48 by hook and loop fastener. Padded bumper 56 may be surrounded by a fluid-resistant plastic sheet 74 and held within compartment 48 by straps 76 operably connected to cover 38 and including a hook and loop fastener 78.

FIG. 8 shows a cross section taken through compartment 30 from FIG. 5. The cross section includes cover 38 held in the closed position by zipper 40. A skinned foam pad 72 may be fastened to bottom 32 of compartment 30 by hook and loop fastener means.

Harness 42 is shown in cross section. Bumpers 37 are wrapped in a plastic sheet 74 and retained in compartment 30 by straps 76 having hook and loop fastener means 78. Fiber boards 80 may be attached to opposite sides of foam pad 36. CPR board 26 is shown disposed between cover 38 and one of the fiber boards 80.

FIG. 9 is an enlarged view of a portion of FIG. 7 showing a portion of bumper 56 surrounded by plastic sheet 74. Bumper 56 is fastened to covering 38 by strap 76.

Figure 10:
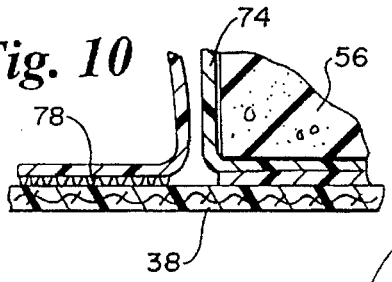
FIG. 10 is a partial cross-section of the gurney mattress in accordance with the present invention showing structure within the circle 10 in FIG. 7.

FIG. 10 is a partial cross-section of mattress 10 taken from FIG. 7 showing hook and loop fastener 78 of strap 76. A similar fastener may be used on all straps 76 for both compartments 30 and 48.

Figure 11:
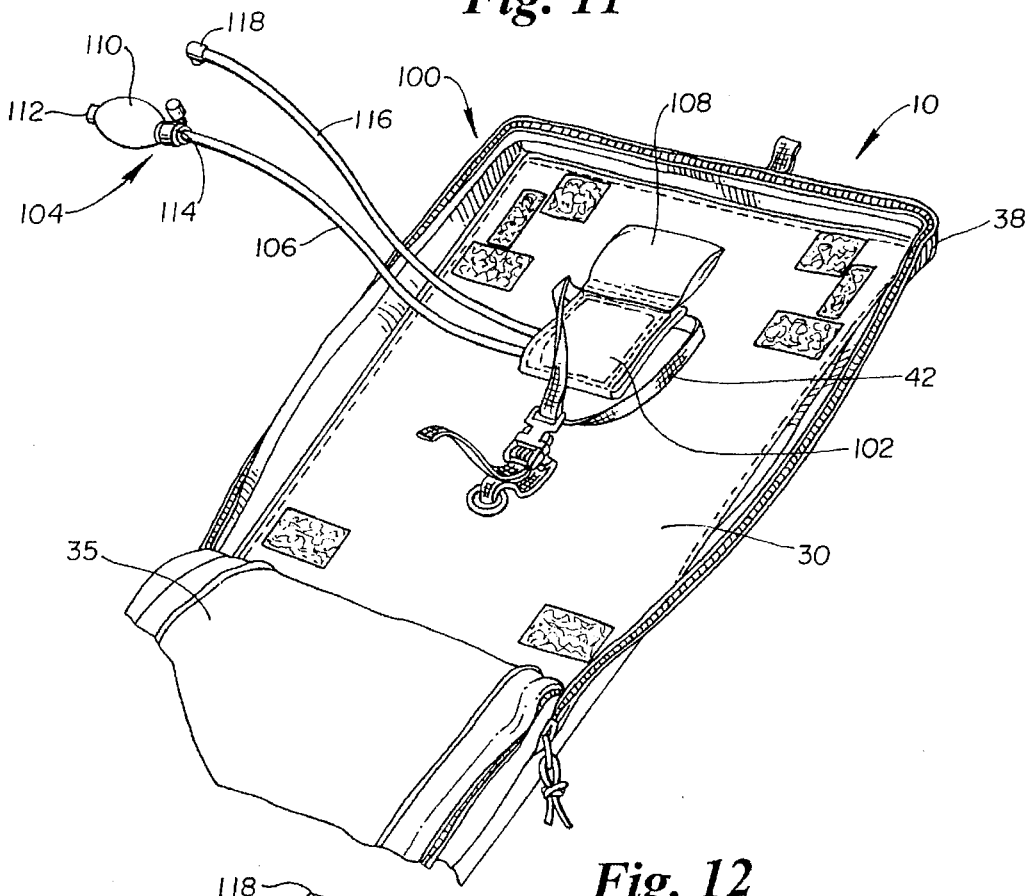
FIG. 11 is a view of an airway opening device incorporated into the gurney mattress of the present invention.

FIG. 11 is a perspective view of an airway opening device 100 in accordance with the present invention. The device 100 includes an inflatable bladder 102 and an inflation device 104 in fluid communication with bladder 102 through a tube 106. As shown in FIG. 10, bladder 102 is connected to elongated cover 38 in compartment 30. In FIG. 11, padded bumpers 37 and head immobilization device 44 have been removed to show airway opening device 100 more clearly. It should be noted that although airway opening 100 is shown connected to elongated cover 38 of mattress 10, the airway opening device 100 as described herein, can also be used on a hospital bed or any surface where a patient can lie supine.

A harness 42 described above may be used to hold a patient on bladder 102. A pillow 108 can be attached to mattress 10 to cushion a patient's head.

Inflation device 104 can include a compressible bulb 110, similar to those used to inflate blood pressure cuffs. Bulb 110 can include a one-way check valve 112 and an operator controllable valve 114. Check valve 112 allows air to enter bulb 110 as it expands, but does not allow air to escape valve 110 as it is compressed by an operator. Valve 114 can be opened or closed to establish or disconnect the fluid connection between bulb 110 and bladder 102.

Airway opening device 100 can include a second tube 116 in fluid communication with bladder 102. A valve 118 can be connected to tube 116 to control the release of fluid from bladder 102.

Figure 12:
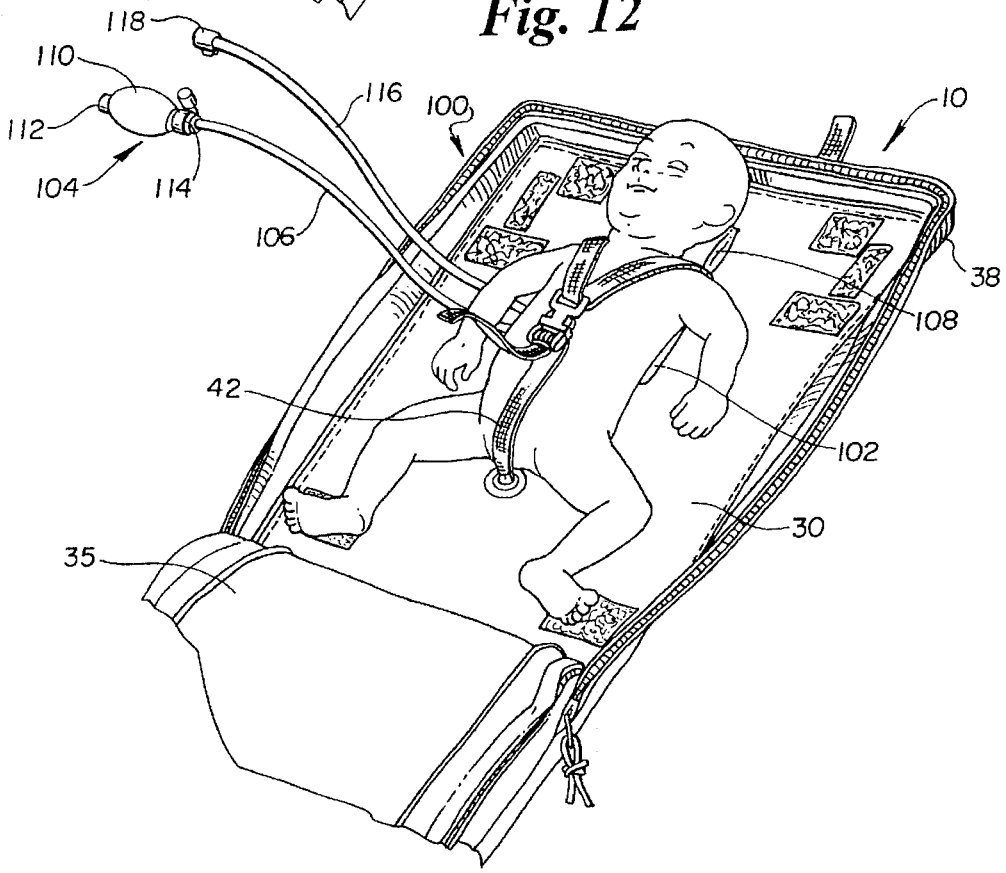
FIG. 12 is a view of the device of FIG. 11 in which a supine patient is laying on a portion of the device.

FIG. 12 is a view of mattress 10 and airway opening device 100, as described by reference to FIG. 11, in which a patient has been placed in a supine position in compartment 30 over bladder 102. Harness 42 has been placed around the patient to retain the patient over bladder 102. As shown in FIG. 12, the patient is a child. It should be understood, however, that airway opening device 100 can also be used with adults. If the device 100 is to be used with adults, a proportionately larger bladder could be used.

Figure 13:
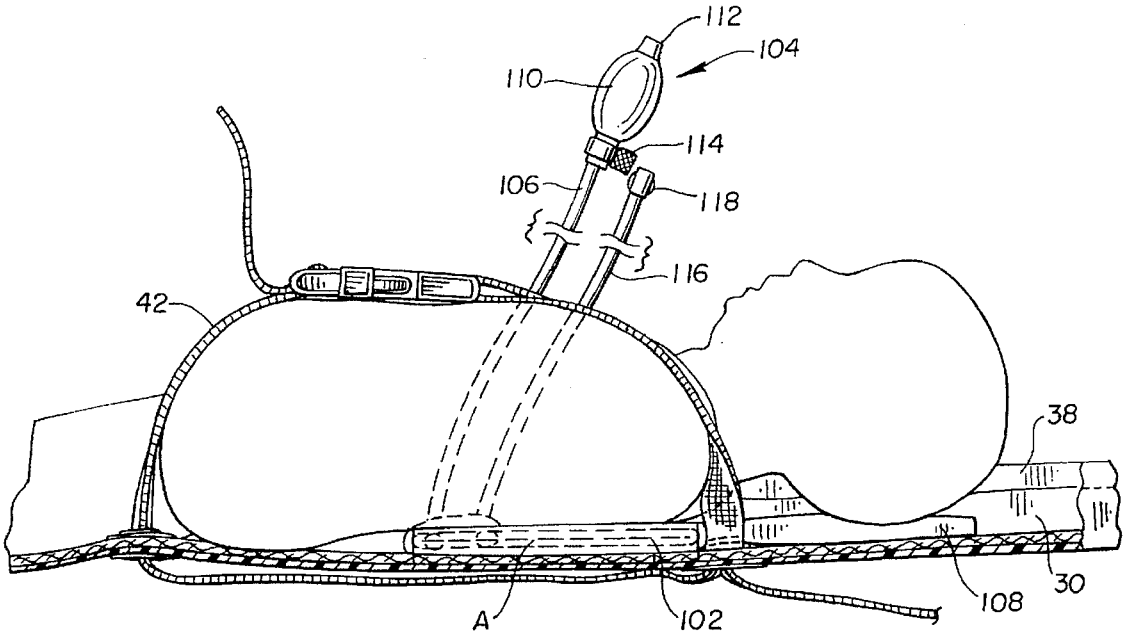
FIG. 13 is a cross sectional view of the airway opening device of FIG. 12 with the device and patient in a first position.
Figure 14:
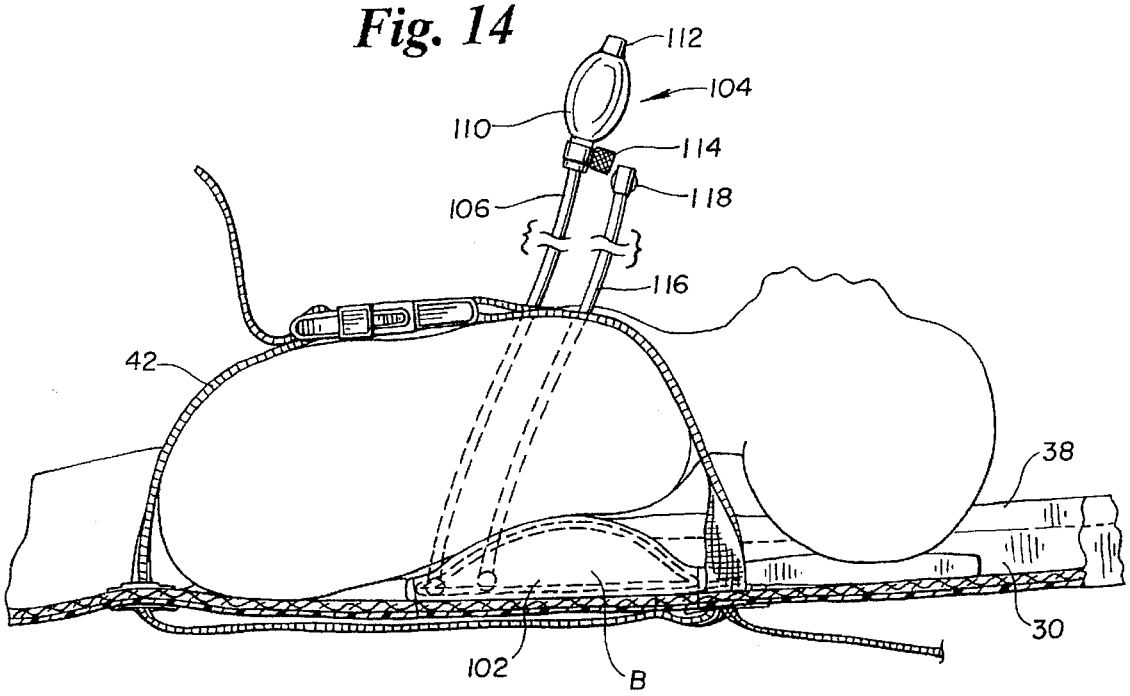
FIG. 14 is a cross sectional view of the device as shown in FIG. 12 with the device and patient in a second position.

FIGS. 13 and 14 are cross sectional views of the device shown in FIG. 12. In FIG. 13, bladder 102 is shown in a first deflate position A. In FIG. 14, bladder 102 is shown in a second inflated position B. As shown in FIGS. 13 and 14, the patient's upper back, proximate the thoracic spine, is placed over bladder 102. As shown in FIG. 13, when bladder 102 is in first position A, the patient lies in a relatively flat position. However, when bladder 102 is in second position B, the upper back and chest of the patient are raised which in turn tilts the patient's head back away from the patient's chest opening the patient's airway.

To inflate bladder 102, valve 114 is opened such that bulb 110 is in fluid communication with bladder 102. Bladder 110 is compressed by an operator forcing fluid, generally air, into bladder 102. When bulb 110 is released, air enters the bulb through check valve 112. Once bulb 110 is filled with air, the operator can squeeze the bulb again to continue inflation of bladder 102. Bladder 102 should be inflated until the patient's head tilts back away from the patient's chest, into a position in which the airway is open for normal or artificial respiration. Bladder 102 can be returned to the first position A by opening valve 118 to release the air through tube 116.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. A gurney mattress, comprising:

an elongated cover surrounding at least one cushion;

a back elevating inflatable bladder connected to the cover;

an inflation device in fluid communication with the bladder for providing fluid under pressure to inflate the bladder; and a harness connected to the elongated cover, the harness configured to retain a person on the mattress and the back elevating inflatable bladder.

2. A gurney mattress in accordance with claim 1, wherein the inflation device is a compressible bulb including a check valve for introducing fluid into the bulb.

3. A gurney mattress in accordance with claim 2, wherein the inflation device includes a second valve to close off fluid communciation between the bulb and the bladder.

4. A gurney mattress in accordance with claim 1, further comprising a bladder pressure release outlet and valve.

* * * * *